United States Patent [19]

Nichols, Jr.

[11] Patent Number: 4,622,044

[45] Date of Patent: Nov. 11, 1986

[54] TEXTILE DYEING PROCESS FOR MULTICOLOR NYLON CARPET

[75] Inventor: David B. Nichols, Jr., Dalton, Ga.

[73] Assignee: RCA Corporation, Princeton, N.J.

[21] Appl. No.: 757,371

[22] Filed: Jul. 22, 1985

Related U.S. Application Data

[63] Continuation of Ser. No. 916,900, Jun. 19, 1978, abandoned.

[51] Int. Cl.[4] ..... D06P 5/00

[52] U.S. Cl. ..... 8/485; 8/446; 8/478; 8/480; 8/924; 8/929; 8/455

[58] Field of Search ..... 8/485, 478

[56] References Cited

U.S. PATENT DOCUMENTS 4,189,302 2/1980 Toland ..... 8/480

*Primary Examiner*—A. Lionel Clingman

*Attorney, Agent, or Firm*—Joseph S. Tripoli; George E. Haas; William Squire

[57] ABSTRACT

A continuous process for dyeing a pre-wetted carpet includes the step of applying a viscous water soluble gum layer over the tufted face of the carpet. Drops of first and second dyes less viscous than the gum are applied over the gum-wetted carpet face. A third dye which is substantially less viscous than the gum and the first and second dyes is applied over the entire tufted surface of the carpet.

9 Claims, 5 Drawing Figures

TEXTILE DYEING PROCESS FOR MULTICOLOR NYLON CARPET

This is a continuation of application Ser. No. 916,900, filed June 19, 1978 abandoned.

The present invention relates to a continuous process for dyeing textiles which is particularly suitable for carpeting.

TAK dyeing, which is a relatively recent development in the carpet industry, is a continuous dyeing process in which dye is deposited, in drops, on the tufted side of the carpet. A wide variety of dye colors may be employed and different random color patterns obtained. Typical apparatuses which may be used for applying the dyes in drops are disclosed, for example, in U.S. Pat. Nos. 3,683,649; 3,800,568; 3,726,640; 3,731,503; 3,964,860; and 4,010,709.

The ever changing tastes of the public places a continuous demand on the carpet industry for new styles which are both pleasing and attractive. In my copending application Ser. No. 661,396, filed Feb. 25, 1976, (now abandoned), I describe a method and apparatus, now in wide use, for producing one group of such styles. In this method, a layer of a liquid, such as a water soluble gum, is applied to the tufted surface of the carpeting and then drops of dye(s) are applied to the gum wetted tufts. The dye or dyes spread, blend, attenuate and provide, in the finished product, randomly varying patterns with gentle shading effects, which are pleasing to the eye.

I describe a second dyeing technique in my U.S. Pat. No. 4,146,362, issued Mar. 27, 1979. Here, a relatively viscous first dye is deposited, for example, in drops onto spaced regions of a textile and a less viscous second dye is then deposited onto regions of the textile which include the spaced regions. The first dye colors the regions of the textile it reaches in the first dye color and masks these regions from the second dye. The second dye colors the regions of the textile it reaches in the second dye color and does not substantially affect the regions of the carpet masked by the first dye. This process provides additional new and pleasing color effects; however, the market continually demands other pleasing styles.

In a process embodying the invention for dyeing a textile, a relatively viscous colorless liquid, such as a water soluble gum, is deposited over a first region of the material. A first viscous dye is deposited on first spaced regions of the material including the regions of material covered by the first liquid. A second viscous dye is then deposited on second spaced regions of the material and then a third dye substantially less viscous than the liquid and the first and second dyes is applied to regions which include the first and second regions.

Of interest are U.S. patent application Ser. No. 916,903, filed June 19, 1978, entitled "Textile Dyeing Process," by David Banks Nichols, Jr.; U.S. patent application Ser. No. 916,901, filed June 19, 1978, entitled "Textile Dyeing Process," by David Banks Nichols, Jr.; U.S. patent application Ser. No. 916,893, filed June 19, 1978, entitled "Textile Dyeing Process," by David Banks Nichols, Jr.; and U.S. patent application Ser. No. 916,889, filed June 19, 1978, entitled "Textile Dyeing Process," by David Banks Nichols, Jr., all of the above being assigned to the assignee of the present invention.

Figure 1:
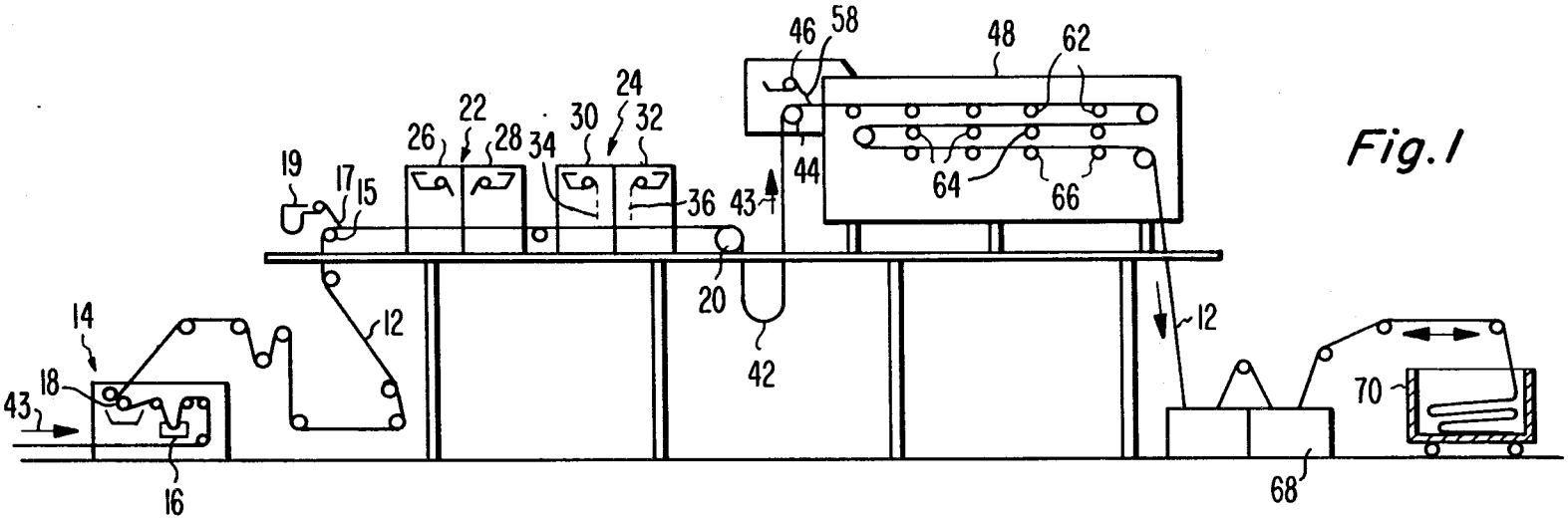
FIG. 1 is a schematic, side elevation view of a carpet dyeing apparatus used to practice the process embodying the present invention.

The apparatus shown in FIG. 1 is particularly suitable for dyeing carpeting. The carpeting 12 is fed from a supply roll (not shown) through a pad machine 14. The latter includes a reservoir 16 containing a pre-wet solution through which the carpet passes. The carpet is then conveyed through two squeeze rollers 18 which remove sufficient prewet solution from the carpet tufts to provide a desired percent "liquid pick-up" in the carpet. The expression "percent pick-up" is a measure of the weight of the liquid in a given area of the carpet and in particular is the ratio of the weight of the liquid in a given area of the carpet to the dry weight of the same area of carpet multiplied by 100.

The pre-wet solution in the reservoir 16 is heated to an elevated temperature of 135° F. This elevated temperature relaxes the yarns and increases their ability to assume any position in which they are placed. That is, it tends to remove some of the pre-stresses in the tufts and they more readily assume and remain in an orientation in which they may be placed. For example, after the carpet web passes through a pair of squeeze rollers which fold the tufts over they tend to remain folded over.

The carpeting 12 is then fed by a plurality of guide rollers upwardly and around roller 17, FIG. 1 and past a viscous liquid applicator 19. An applicator of this type is described in detail in my now abandoned application Ser. No. 661,396, filed Feb. 25, 1976. In the present process the applicator 19 applies a sheet of colorless viscous gum to the tufted face of the carpet over the entire width of the carpet web. This gum is a water base vegetable gum solution which is chemically inert with respect to later applied dyes. Chemically inert implies that there is no chemical reaction between the gum and the dye. The carpet web is oriented horizontally at this point. The web of carpeting is then pulled horizontally over guide rollers by drive roller 20 through machines 22 and 24.

Machine 22 comprises two identical, separate drop dispensing applicators 26 and 28 which are opposite and facing each other. Machine 24 also comprises two separate and independent identical drop dispensing applicators 30 and 32. Machine 24 has the capability of dispensing drops (or streams) of a liquid in a zig-zag pattern over spaced areas 38 *a–e* and 40 *a–d*, FIG. 4 and is sometimes referred to as a mult-TAK machine. For purposes of the following discussion "drops" will be referred to by way of example but it is to be understood that this is intended to be generic to drops, streams and so on. Applicator 30 applies patterns 38 *a–e* of FIG. 4 and applicator 32 applies patterns 40 *a–d*. Note in FIGS. 1 and 4 that the direction of carpet movement is as indicated by arrow 43.

The machine 22, on the other hand, is capable of dispensing drops (or streams) of liquid randomly over the entire tufted face of the carpet and is referred to as a TAK machine. A machine similar to machine 24 is illustrated in U.S. Pat. No. 3,964,860 and a machine similar to machine 22 is described in U.S. Pat. No. 4,010,709.

The carpet is then conveyed downward into a tension compensating loop 42 and then upward to an elevation above the level of the carpeting 12 in the machines 22 and 24 to roller 44. The web of carpeting traverses around roller 44 beneath dye applicator 46. The latter, which is of conventional construction, is sometimes known as a Kusters applicator. Dye applicator 46 applies a continuous sheet or layer of dye to the tufted surface of the carpeting, over the entire width of the carpeting. In the application region, the carpeting is horizontally oriented.

Figure 2:
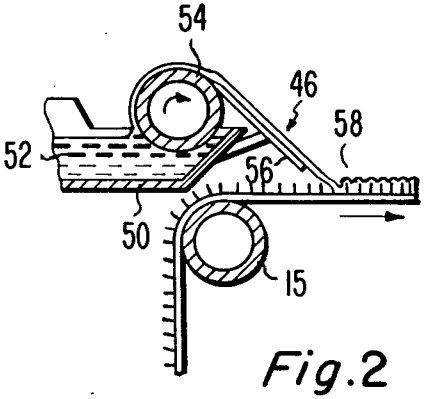
FIG. 2 is a side elevational view of a portion of the apparatus of FIG. 1.

FIG. 2 illustrates a portion of the dye applicator 46. It includes a pan 50 for receiving a dye 52 and a roller 54. The roller picks up a layer of the dye from reservoir 52 and this layer is brought into contact with the edge of doctor blade 56. The latter peels a sheet 58 of the dye away from the roller and delivers it to the tufted surface of the carpet. The gum applicator 19 includes similar structure; however, a special set of input ports is employed to insure that the viscous gum will be of uniform height, as explained in my copending application 661,396.

The carpet enters the steamer 48 after it passes the applicator 46. The steamer includes a first set of rollers 62 for transporting the carpet in a first horizontal pass in the steamer, a second set of roller 64 for transporting the carpet in a second horizontal pass in the steamer, this one with the tufts pointing downward, and a third set of rollers 66 for transporting the carpet in a third horizontal pass in the steamer.

The carpet exits the steamer in a substantially downward direction and passes into a washing apparatus 68. The latter has two compartments for washing the carpet and for removing unfixed dye, gum and chemicals from the carpet. The gum viscosity is lowered in the steamer as a result of being heated and is readily removed in the washing apparatus. The remaining excess elements also are readily removed. The washed carpet passes into a suitable container 70 and is later transported to and dried in drying machine (not shown).

In carrying out the process of the present invention, reservoir 16 in the pad machine 14 is filled with a prewet solution formed of water, surfactant, fabric softener and a defoamer and having a pH of about 7. The pH of the bath in reservoir 16 affects what occurs in the steamer. If the pH is alkaline, it serves to slow down the fixing of the dyes in the steamer. This may allow them to wick down to the tuft tips more than desired (for purpose of creating a particular dyeing effect) during the second horizontal pass. In the present process, the desired effect is obtained by making the pH of the bath in reservoir 16 neutral or somewhat acid. This helps neutralize the subsequently applied liquids to prevent fixing prior to the steamer. This also allows blending of some of the later applied colors as will be explained. The carpet is then squeezed to the desired percent pick-up, preferably 130–140 percent.

The sheet 17 of relatively viscous colorless gum (or other suitable liquid carrier) applied to the face of the carpeting preferably has a viscosity of about 1800 CPS but can lie within a range of about 600–5000 CPS. This sheet of gum may be about a quarter of an inch thick and is of uniform thickness when applied across the entire face of the carpet.

The gum applied to the carpet tends to sink into the spaces between the tufts and to coat varying portions of the tufts, as will be discussed in detail later. The depth to which the gum penetrates will vary at different parts of the carpet. In general, the viscosity of the gum is sufficiently high that it does not sink all of the way to the carpet backing, although this may occur in isolated small regions.

In the present process, the machine 22 for applying drops of liquid is not in use and there is a relatively long distance between the applicator 19 and the first drop applicator 30 in use. In one example, this distance is roughly 12½ feet. The carpet traverses this distance in about 25 seconds. A gum viscosity of 1800 CPS is found, in practice, to provide an average depth of gum penetration into the carpeting of approximately 30 to 40 percent. This produces one kind of effect in the finished product. Lower gum viscosities permit deeper average gum penetration and higher gum viscosities shallower average penetration for different effects in the finished product for a given tufting density, lay of tufts, and time for penetration. The distance traveled affects the depth of gum penetration by affecting the time the gum is permitted to penetrate. The viscous gum may be made from any suitable vegetable base as described in the aforementioned copending application 661,396 The gum base is mixed with a defoamer, a preservative and acetic acid to provide a slightly acidic solution having a pH preferably in the range of 5.5–6.

The pH of the gum used in the process is significant. The higher the pH of the gum, the less the dye exhausts in the region of the tufts coated with or saturated by the gum, that is, when the carpet reaches the steamer very little of the acid dye will fix to the tufts covered or saturated by a substantially higher pH gum. For example, if the pH of the gum were very high, say 10.5, a minimum amount of the acid dye (say of pH 3) would fix to this tuft. In practice, the gum may have a pH of 5.5–6 as an example, and this does have an effect in reducing the ability of a latter applied dye to fix to a tuft coated with this gum.

The drop applicator 30 contains a first dye, color 1, which may be mixed with formic acid, a defoamer agent, a wetting agent, gum and water having combined viscosity of about 600 CPS and a pH of about 3. The applicator 32 contains a second dye, color 2. This dye may have a viscosity which is about the same as that of the gum in applicator 30, that is, a viscosity of about 600 CPS, and a pH of about 3, in this example (or its viscosity may be different than that of the color 1 dye; however, it should be in a given range of viscosities as discussed later). The dye formulation is conventional. Dyes suitable for use with nylon carpeting are preferably water soluble acid dyes. In general, the dye may be formulated by mixing a number of different primary color dyes to form the desired color shade. The dye is selected to be compatible with the particular synthetic, natural or mixtures of fibers in the particular tufts being dyed.

Figure 4:
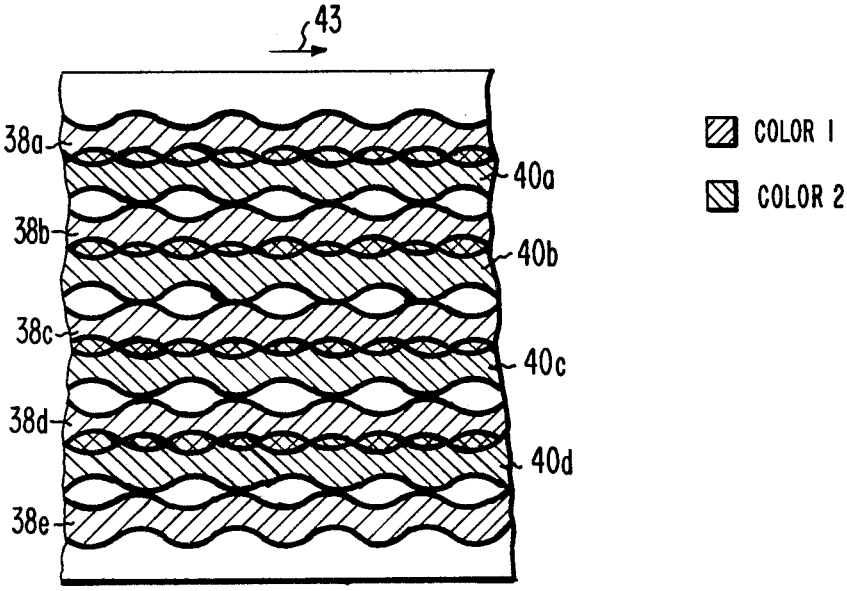
FIG. 4 illustrates some of the patterns produced by the apparatus of FIG. 1.

Applicators 30 and 32 dispense their respective liquids in drops and the drops are confined to the spaced areas 38 *a–e* and 40 *a–d* respectively, shown in FIG. 4. In the particular design illustrated, the dye drops produced by applicator 30, fall on regions 38 *a–e* which are spaced from one another by intermediate regions which are not reached directly by these drops (although there may be some splashing). The dye drops produced by applicator 32 form a similar type of pattern in regions 40

*a–d* which are spaced from one another. However, the patterns 38 and 40 produced by applicators 30 and 32 respectively, may or may not overlap entirely or partially. Some of the individual drops 34 dispensed by the applicator 30 may fall on some of the same tufts as the drops 36 dispensed by the applicator 32 and other of the respective drops will reach different tufts.

The reservoir of applicator 46 is filled with a third dye in another shade or color, call it color 3, which is substantially lower viscosity than the color 1 and 2 dyes. For example, if colors 1 and 2 dyes have a viscosity of 600 CPS, the color 3 dye may have a viscosity of from 15–60 CPS, but could vary from this somewhat to achieve its desired effect, as will be explained.

While the dyes disclosed herein are water soluble acid dyes, for use on nylon yarns, it should be understood that other yarn material, and also other types of dyes that are suitable for these other materials may be used instead.

There are a number of factors which must be considered in choosing the viscosity of the color 1 and 2 dyes. The viscosities must be sufficiently high that the dye masks those tufts or the portions of the tufts the colors 1 and 2 reach, from the lower viscosity later Kusters applied dye (applied by 46). For a Kusters applied dye (color 3) at a viscosity of about 30 CPS, the colors 1 and 2 should have a viscosity of at least about 600 CPS to carry out this function. The higher the viscosity of colors 1 and 2, the greater their shielding effect, for a given dye 3 viscosity. The viscosity of colors 1 and 2 also should be sufficiently low so that the drops of colors 1 and 2 readily can penetrate into (and through) the sheet of the gum (applied at 19). For a gum viscosity of 1800 CPS, the colors 1 and 2 viscosities should not be higher than about 1200 CPS. If the gum viscosity is greater than 1800 CPS, then the colors 1 and 2 viscosities can be greater than 1200 CPS; similarly if the dye 3 viscosity is lower than 30 CPS, the colors 1 and 2 viscosities can be lower than 600 CPS. The lower the viscosity of dyes 1 and 2, the quicker the penetration of these dyes through the gum, for a given gum viscosity, all other things being equal. Within the range specified, different viscosities chosen for colors 1 and 2 will cause different dyeing effects, generally in subtle ways.

Each of the dyes may be prepared and selected from available colors in the manner described in detail in the U.S. Pat. No. 4,146,362, issued Mar. 27, 1979. The pH's of the two dyes (colors 1 and 2) used are acidic; and may have a value of 3 or so, so that the dyes will fix relatively quickly in the steamer 62. This pH value is not critical and could vary. In one particular process, it is estimated that about 90–95 percent of the dyes become fixed during the first horizontal pass of the carpet within the steamer 48. In one example, the carpet traverses each pass somewhat more than one minute to achieve this affect.

Figure 3:
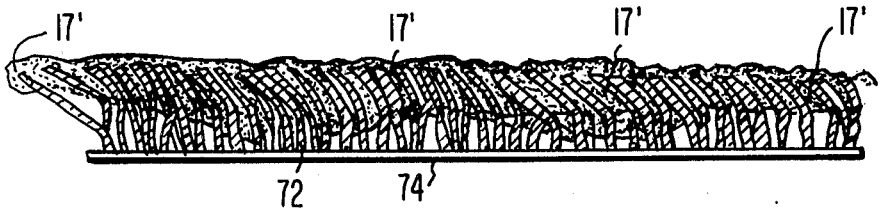
FIG. 3 is a sectional elevational view of a carpet showing tufts with a viscous liquid thereon.
Figure 5:
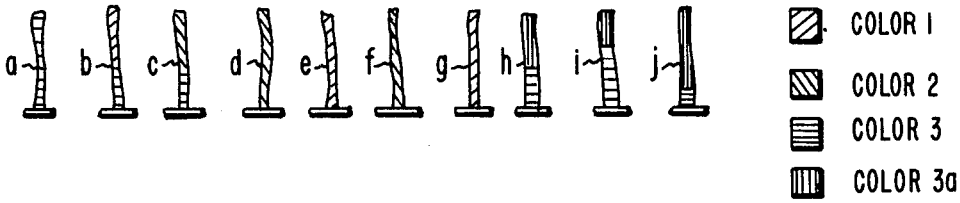
FIG. 5 is a side elevational view of some of the tufts illustrating several combinations of coloring that takes place in the process embodying the present invention.

The various steps in the dyeing process are illustrated in FIGS. 3–5. FIG. 3 shows the gum applied by the applicator 19 after the carpet has moved a distance from the point of application of the gum and before this section of carpet has reached the applicator 30. The gum coating 17' penetrates into the carpet tufts to an average depth of 30–40 percent or so as discussed above. However, in some areas, such as 72, depending on the density of the tufts and the lay of the tufts, the penetration may be more, even to the backing 74. The penetration is relatively slow, and, therefore, FIG. 3 represents the approximate penetration of the gum prior to reaching the steamer 48.

Because some of the tufts may be upright or more loosely packed, due to the traverse of the carpet around the guide rollers, some of the gum may penetrate more quickly or more deeply. Occasional tufts may be coated about half-way on only one side by the gum coating 17'. A majority of the tufts are coated at the upper tip by coating 17'. A tuft occasionally may be underneath and protected by other tufts and may not receive any gum at all. Other less numerous tufts may be fully coated with gum or with spots or flecks of gum.

As the carpet web traverses beneath the applicator 30, drops 34 of the relatively less viscous color 1, first dye, fall onto the gum-wetted carpet tufts. As a result of the force of gravity, these drops tend to penetrate the surface of the more viscous gum layer and in some cases they pass through the viscous gum and reach the base of one or more tufts. Due to the relatively loose packing of some tufts receiving some of the drops, those drops tend to penetrate more easily than the drops over more densely packed tuft areas. A relatively loosely packed area may be one containing tufts which have returned to a generally upright position and more densely packed area may be one where the tufts have remained folded over and compressed. The drops of color 1 tend to color the tufts receiving them, whether or not these tufts are coated with the gum.

The carpeting then passes beneath the applicator 32 and certain of the tufts receive spaced drops 36 of the relatively less viscous color 2, second dye. The tufts receiving color 2 are colored by this dye. Those tufts receiving just the gum and color 2 have a greater affinity for a color 2 than the tuft receiving gum, colors 1 and 2. The reason is the attenuation of color 2 by color 1. That is, the tufts already colored in color 1, have less space available for reception of and coloring by the color 2 dye.

In those regions of the carpet which are more dense, the penetration of the dye drops is slowed down. The drops of dye colors 1 and 2 dye in these areas tend to color only those parts of the tufts over which the drops land. Thus, where a fiber is bent over and a drop lands on the gum, it may remain in suspension in the gum for a longer period and finally may reach and color any part of the surface (facing upward) of the tuft. This may be at the tip of or along the side of the tuft. In adjacent regions where the fibers are more loosely packed, the dye drops may pass through the gum and reach the fibers more quickly and may run down and color a greater part of the tuft surface.

The carpet then traverses around roller 20 into the loop 42 and then around roller 44. The carpet then receives a film of very low viscosity dye color 3 from applicator 46 over the entire tufted surface of the carpet. Those tufts that are coated with gum or dye have a relatively low affinity for any of this dye as discussed above. Those tufts or portions thereof that are completely free of the previous applied dyes or gum liquid, which due to their viscosities may not penetrate through to all of the tufts, are dyed a deep shade by the color 3 from applicator 64.

If tufts of a carpet are examined after they are processed, many combinations and permutation of coloring effects on the different tufts will be observed. A number of samples are given in FIG. 5, but these are intended as examples only and are not to be considered limiting as to the different combinations of color effects that occur.

Tuft a in FIG. 5 is one which was covered by other tufts and so did not receive any gum. This tuft is relatively rare. No drop of dye color 1 or color 2 fell on this tuft. This tuft being unprotected by a viscous gum or dye was completely dyed to the deepest shade by the low viscosity color 3 dye.

Tuft b was one of the majority of tufts coated on the upper part (say the upper third or a half of the tuft) by the gum layer. This tuft then received a drop of color 1 which proceeded to color this tuft on the upper portion reached by this drop. This tuft did not receive the second dye color 2. Color 3 dyed only the lower unprotected half of this tuft.

Tuft c is similar to tuft b except that tuft c was colored by color 2 on the upper portion. Color 3 dyed the unprotected lower portion.

Tuft d was coated with gum on the upper third portion. A drop of color 2 fell on this tuft and ran down the tuft coloring the entire tuft. This tuft did not receive a drop of color 1. The entire tuft being protected by color 2 was not receptive of color 3, and color 3 is absent from this tuft.

Tuft e is similar to tuft d except tuft e was colored only by color 1 throughout. No color 3 is present in this tuft.

Tuft f was coated with gum on the upper third portion. A color 3 drop fell on this tuft coloring it 80 percent. No gum or color 1 was absorbed by the lower 20 percent. The lower 20 percent was colored with color 3.

Tuft g is similar to tuft f except this tuft was colored by color 1 instead of color 2 on the upper 80 percent, the lower 20 percent was colored with color 3.

Tuft h was coated with gum on the upper half. No color 1 or color 2 touched this tuft. The lower half was colored with color 3. In the steamer the gum on the tip lost its viscosity due to the heat in the steam and the gum ran off the tuft diluting the color 3 on the base portion. This diluted dye ran to the tip portion of the tuft during the second pass through the steamer when the tip of the tuft extended downwardly and colored the tip with diluted color 3, identified as color 3*a*. While the low pH's (say about 3) permitted a relatively quick fixing of the colors 1 and 2 in the steamer during the first pass, some of the low viscosity color 3 at a relatively higher pH (say about 5) did not fix completely at this point and was able to dye the tuft's tip when the tip was upsidedown.

Tuft i is similar to tuft h except the gum coated area is confined to the upper third portion.

Tuft j is similar to tuft h except that the gum coated area is over the upper 80 percent to the tuft.

Still other fewer tufts may be splattered partially with one or both dyes and colored by then. Most of the tufts not colored by dyes colors 1 and 2 appear as tufts h, i, and j. For this reason, color 3 generally is made a deeper shade than colors 1 and 2 or a shade which is complementary to that of colors 1 and 2 since it is a predominant color in many of the tufts. Colors 1 and 2 may be lighter shades of color 3.

The different coloring effects shown in FIG. 5, are combinations that actually occur. There are many other combinations of coloring effects which also occur and which are too numerous to describe herein. As is now apparent, a multi-color effect is achieved by this process, using only a few colors. Many of the tufts have varied shadings and colors, providing a darker color at the base of some tufts, a lighter overall effect for the other tufts and variations of colors 1, 2 and 3 blended throughout as well as diluted colors present on the tips of some of the tufts.

By applying the more viscous dyes in applicators 26 and 28 instead of 30 and 32 still other similar types of coloring effects may be achieved but in a slightly different pattern. However, the sequence, which is of significance, is that the drop applied dyes be applied over the sheet applied viscous gum prior to the last applied dye of very low viscosity. Most of the tufts have their bases colored with color 3 due to the lack of deep penetration by gum 1 or dyes colors 1 and 2.

While particular drop applicators have been described, the manner of applying the colors 1 and 2 may vary from that shown as long as these are applied in spaced regions of the carpet, rather than to all of the tufts. The gum and high viscosity dyes act as a shield to the low viscosity color 3 dye and it may be applied right over the gums and the color 1 and 2 dyes in the manner described. The following are specific examples of processes embodying the present invention:

EXAMPLE 1

The textile is a 12 foot wide carpet comprising backing material with nylon yarn in a 12 foot width. This carpet is first treated with the following heated pre-wet solution in the pre-wet bath.

| | |
|---|---|
| 6.81 kg | "Pomoco JW" a tradename of Piedmont Chemical Industries North Carolina which is a long, chain fatty alcohol amide with anionic surfactant. |
| 11.35 kg | "Chemcoloft 75-N" a tradename of a Chemical Processing of Georgia Company which is a fabric softener formed of a fatty imidazoline polyethylene emulsion |
| 1.0 kg | "Quadafoam MA" which is a tradename for Quaker Chemical Corporation, North Carolina which is a modified silicone base formed of silicone and chlorinated parafin used as a defoamer. |

The above ingredients are dissolved in sufficient water at a temperature of 135° F. to produce a 5000 lb. mixture having a pH of 7 and zero viscosity. This solution is placed in the pad machine 14. The carpet is run at 30 feet per minute through the pre-wet solution in the pad applicator with 30 lbs. per square inch of roller pressure on the pre-wet carpet providing 140 percent pick-up of the pre-wet solution.

| GUM APPLICATOR 19 | |
|---|---|
| 4.54 kg | Syngum D47D manufactured by the Stein Hall Company or General Mills |
| 0.454 kg | Quadafoam MA |
| 0.454 kg | DXN a preservative, Dimethoxano |
| 0.068 kg | Acetic Acid |

The above ingredients are mixed together with sufficient tap water at room temperature to provide a 1000 lb. mixture having a viscosity of 1800 CPS and a pH of 5.5–6.

A premeasured tank is filled about half-way with the heated tap water. The gum is added and then mixed. The remaining chemicals are then added with the acid added last. Water is then added to a predetermined level to produce the desired 1000 lb. mixture. This mixture is then mixed for about 2 hours. A similar procedure is followed for the dye mixtures described below.

| COLOR 1, APPLICATOR 30 | |
|---|---|
| 4.09 kg | Progowet FS a tradename of the Chemical Process of Georgia Company which is an ethoxylated alephated alcohol |
| 4.08 kg | Formic Acid |
| 8.4 kg | Syngum D47D |
| 0.6 kg | Quadafoam MA |
| 1.350 kg | Acid Yellow 219 |
| .333 kg | Acid Red 337 |
| .180 kg | Acid Blue 277 |

The above ingredients are mixed with tap water heated to room temperature to made a 3000 lb. mixture having a pH of 3 and a miscosity of 600 CPS.

| COLOR 2, APPLICATOR 32 | |
|---|---|
| 4.09 kg | Progowet FS |
| 4.08 kg | Formic Acid |
| 8.4 kg | Syngum D47D |
| 0.6 kg | Quadafoam MA |
| .0225 kg | Acid Yellow 219 |
| .900 kg | Acid Blue 277 |

The above ingredients are mixed with sufficient tap water at room temperature to produce a 3000 lb. mixture with a pH of 3 and a viscosity of 600 CPS. This mixture is applied to patterned areas in drop form.

| COLOR 3, APPLICATOR 46 | |
|---|---|
| 1.14 kg | Acedic Acid |
| 5.0 kg | Syngum D47D |
| 0.5 kg | Quadafoam MA |
| 1.00 kg | H-100 a tradename of WACO Chemical Company of Dalton, which is a chelating agent or water softener, comprising Ethylene Diamine Tetra Acetic Acid (EDTA) |
| .360 kg | Acid Yellow 219 |
| 12.0 kg | Acid Blue 277 |

The above ingredients are mixed with sufficient tap water at room teperature to make a 10,000 lb. mixture having a pH of 5 and a viscosity of 50 CPS. This mixture is applied to the entire carpet as a film.

EXAMPLE 2

The textile material is the same as in Example 1.

| PRE-WET | |
|---|---|
| 4.09 kg | Pomoco JW |
| 6.81 kg | Chemoloft 75-N |
| 0.60 kg | Quadafoam MA |
| 0.2 kg | Acedic Acid |

The above ingredients are dissolved in sufficient tap water at a temperature of 135° F. to produce a mixture having a pH of 7 at zero viscosity. This solution is placed in pad machine 14. The carpet is run at 30 feet per minute through the pre-wet solution in the pad applicator with 30 lbs. lbs. per square inch of roller pressure on the pre-wet carpet providing 140 percent pick-up of the pre-wet solution.

GUM, APPLICATOR 19

The gum mixture is the same as in Example 1.

| COLOR 1, APPLICATOR 30 | |
|---|---|
| 3.240 kg | Acid Yellow 219 |
| .360 kg | Acid Red 337 |
| .090 kg | Acid Blue 277 |

The remaining chemicals are the same as in Example 1.

The above ingredients are mixed with tap water at room temperature to make a 3000 lb. mixture having a viscosity of 600 CPS and a pH of 3.

| COLOR 2, APPLICATOR 32 | |
|---|---|
| .108 kg | Acid Yellow 219 |
| .026 kg | Acid Red 337 |
| .036 kg | Acid Blue 277 |

The remaining chemicals are the same as in Example 1.

The above ingredients are mixed with tap water at room temperature to make a 3000 lb. mixture having a viscosity of 600 CPS and a pH of 3.

| COLOR 3, APPLICATOR 46 | |
|---|---|
| 15.120 kg | Acid Yellow 219 |
| 4.536 kg | Acid Red 337 |
| 2.412 kg | Acid Blue 277 |
| 0.68 kg | Acedic Acid |
| 0.60 kg | H-100 |
| 3.0 kg | Syngum |
| 0.3 kg | Quadafoam MA |

The above ingredients are mixed with sufficient tap water at room temperature to make a 6000 lb. mixture having a viscosity of 50 CPS and a pH of 5.

In all of the above examples, the pH may be set to the desired value by adjusting the amount of acid added to amounts different than in the examples due to variations in pH in the water and the other elements added.

Nylon carpeting produced in accordance with the two examples above contained multi-color hues in which the dyes colored by applicators 30, 32 and 46 were separately visible on the finished carpet. Variations of shading were observed from dark to light color exhibiting variations in the depth of color applied by applicator 46. The overall impression was that of a pleasing multi-shading effect of a given base color.

It is to be understood that particular compositions or numbers of dyes used in the example above are not critical to the invention. While the dyes formulated in the examples above were made with a water base, it would be equally apparent that dyes with other bases having a different viscosity could also yield similar effects.

What is claimed is:

1. A tufted nylon textile dyeing process comprising:

applying a sheet of a colorless viscous aqueous vegetable gum solution at a pH of about 5.5–6 and at a first viscosity in a range of about 600–5000 CPS over the entire surface of the textile, said vegetable gum solution being miscible with and chemically inert with first, second, and third aqeous solutions of water soluble acid dyes of first, second, and third respective colors, the first and second dyes each at a pH of about 3 and the third dye at a pH of about 5, then applying said first dye which is at a second visosity of about ⅓ the value of the first viscosity to a first portion of said surface coated with said vegetable gum solution, then applying said second dye which is at a third viscosity of about ⅓ the value of the first viscosity to a second portion of said surface coated with said vegetable gum solution after applying said first dye, then applying said third dye which is at a fourth viscosity of roughly about 1/10th or less than the value of the first and second acid dye viscosities to a third portion of the coated surface greater in area than and including said first and second portions, wherein said first and second dyes and said vegetable gum solution substantially mask said textile where coated from said third dye and said dyes penetrate said liquid prior to being fixed, and fixing said dyes to said textile material.

2. The process of claim 1 further including the step of pre-wetting said material with a pre-wet solution prior to said applying said sheet of colorless viscous liquid.

3. The process of claim 2 wherein said pre-wetting step includes the steps of heating said pre-wet solution and then applying said heated solution to said material.

4. The process of claim 1 wherein said fixing step includes steaming said material to fix said dyes and reduce the viscosities of said liquid and dyes, to thereby dilute said third dye, transporting the material in a first pass in a steamer with the coated surfaces facing upwardly and then in a second pass in the steamer with the coated surface facing downwardly to dye said material with said diluted dye where previously masked by said liquid.

5. A process for dyeing a tufted nylon textile material comprising:

passing the textile material through a pre-wet aqueous solution, after removal from the pre-wet solution, squeezing a portion of the pre-wet solution from the textile material, applying a layer of a relatively viscous, colorless, inert aqueous solution of a vegetable gum to the tufted surface of the textile material, said layer having a first viscosity in the range of about 600–5000 CPS, transporting the textile material with its surface coated with said liquid, applying drops of a first aqueous solution of water soluble acid dye of a first color onto the wet, gum coated surface of the textile material during said transporting, said first dye having a second viscosity of about ⅓ that of the gum solution and a pH of about 3, then applying drops of a second aqueous solution of water soluble acid dye of a second color onto the coated wet surface of the textile material during said transporting, said second dye having a third viscosity of about ⅓ that of the gum solution and a pH of about 3 then applying a layer of a third aqueous solution of water soluble acid dye of a third color over said surface during said transporting, said layer having a fourth vlscosity of roughly about 1/10 or less than the value of the first and second dye viscosities so as to be substantially masked from those portions of the textile material receiving said layer of gum and drops of first and second dyes, fixing said dyes to said material including steaming said textile material first with said textile material facing upwardly and then facing downwardly, and removing said gum from said material.

6. The process of claim 5 wherein said pre-wet solution has a pH of 7 and zero viscosity.

7. A continuous process for dyeing a tufted nylon carpet web while the web is moving comprising the steps of:

passing the web through an aqueous bath which includes ingredients for relaxing the tufts;

next passing the web through squeeze rollers for both squeezing some of the bath liquid from the web and for causing the tufts to bend over;

applying to the tufted surface of the carpet while the majority of the tufts are still in the bent over condition, a viscous aqueous vegetable gum solution at a somewhat acid pH at a viscosity in the range of about 600–5000 CPS;

applying to the gum wetted tufts of the carpet, drops of an aqueous solution of a first acid dye of a first color at a viscosity of roughly one third that of the gum solution and at a pH which is more acid than that of the gum;

next applying to the gum and first dye wetted surface of the carpet, drops of an aqueous solution of a second acid dye of a second color at a viscosity roughly comparable to that of the first acid dye solution and at a similar pH to the first acid dye solution;

then applying to the entire tufted surface of the carpet web, while the previously applied ingredients still are wet, an aqueous solution of a third acid dye of a third color at a viscosity which is roughly one tenth or less than the viscosity of the first acid dye solution and at a pH more acid than that of the liquid; and fixing the dyes to the carpet tufts by steaming the carpet web first while the tufts extend upward and then while they extend downward.

8. A tufted nylon textile dyeing process comprising:

applying a sheet of a colorless viscous liquid comprising an aqueous solution of a vegetable gum at a first viscosity in the range of about 600–5000 CPS over the entire surface of a textile material, said vegetable gum solution being miscible with and chemically inert with first, second, and third aqueous solution of water soluble acid dyes of respective first, second and third colors, then applying said first dye which is at a second viscosity of about ⅓ that of the gum vegetable gum solution and which is soluble in said vegetable gum solution to a first portion of said surface coated with said vegetable gum solution, then applying said second dye which is at a third viscosity about the same in value as said second viscosity and which is soluble in said vegetable gum solution and said first dye to a second portion of said surface coated with said vegetable gum solution after applying said first dye, then applying said third dye which is at a fourth viscosity of roughly about 1/10 or less than the value of said second and third viscosities to a third portion of the coated surface greater in area than and including said first and second portions, said third dye viscosity being sufficiently lower than said first, second and third viscosities so that said first and second dyes are separately visible on said textile material and said coated surface substantially masks said textile material where coated from said third dye, said first and second dyes having a pH of about 3, the third dye a pH of about 5 and the vegetable gum solution a pH in the range of 5.5–6, and fixing said dyes to said textile material.

9. A tufted nylon textile material dyeing process comprising:

applying a sheet of a colorless viscous liquid comprising an aqueous solution of a vegetable gum at a first viscosity in the range of about 600–5000 CPS over the entire surface of the textile material, said vegetable gum solution being miscible with and chemically inert with first, second, and third aqueous solution of acid dyes of respective first, second and third colors, the first and second dyes at a pH of about 3, the third dye at a pH of about 5 and the gum vegetable gum solution at a pH of about 5.5–6, then applying said first dye which is at a second viscosity of about $\frac{1}{3}$ the value of the first viscosity and which is soluble in said vegetable gum solution to a first portion of said surface coated with said vegatable gum solution, then applying said second dye which is at a third viscosity about the same in value as the second viscosity and which is soluble in said vegetable gum solution and said first dye to a second portion of said surface coated with said vegetable gum solution after applying said first dye, then applying said third dye which is at a fourth viscosity of about 1/10 the viscosity of said second and third viscosities to a third portion of the coated surface greater in area than and including said first and second portion, said third dye viscosity being sufficiently lower than said first, second and third viscosities so that said first and second dyes are separately visible on said textile material and said coated surface substantially masks said textile material where coated from said third dye, and fixing said dyes to said textile material including steaming said material to fix said dyes and reduce the viscosities of said liquid and dyes, to thereby dilute said third dye, and transporting the material in a first pass in a steamer with the coated surface facing upwardly and then in a second pass in the steamer with the coated surface facing downwardly to dye said material with said diluted dye where previously masked by said liquid.

* * * * *